US007717812B2

(12) United States Patent
Winger

(10) Patent No.: US 7,717,812 B2
(45) Date of Patent: May 18, 2010

(54) WATER-BASED SPORT TRAINING

(76) Inventor: Dale R Winger, 5876 S. Richey Park La., Monticello, IN (US) 47960

( * ) Notice: Subject to any disclaimer, the term of this patent is extended or adjusted under 35 U.S.C. 154(b) by 96 days.

(21) Appl. No.: 12/044,964

(22) Filed: Mar. 8, 2008

(65) Prior Publication Data

US 2009/0227400 A1 Sep. 10, 2009

(51) Int. Cl.
*A63B 69/00* (2006.01)

(52) U.S. Cl. ..... 473/451; 482/111

(58) Field of Classification Search ..... 473/451, 473/228, 566; 482/111; D21/722, 725; 273/317.6

See application file for complete search history.

(56) References Cited

U.S. PATENT DOCUMENTS 3,809,397 A * 5/1974 Gruenewald ..... 473/457
4,416,451 A * 11/1983 Solloway ..... 482/111
4,480,829 A * 11/1984 Yacoboski ..... 482/111
4,720,104 A 1/1988 DiSieno
5,180,163 A 1/1993 Lanctot et al.
5,301,940 A 4/1994 Seki et al.
5,364,095 A 11/1994 Easton et al.
5,395,108 A 3/1995 Souders et al.
5,409,214 A 4/1995 Cook
5,458,330 A 10/1995 Baum
5,460,369 A 10/1995 Baum
5,472,394 A * 12/1995 Michaelson ..... 482/74
5,533,723 A 7/1996 Baum
5,620,179 A 4/1997 MacKay, Jr.
5,624,114 A 4/1997 Kelsey
5,624,115 A 4/1997 Baum
5,676,609 A 10/1997 Mollebaek
5,676,610 A 10/1997 Bhatt et al.
5,722,908 A 3/1998 Feeney et al.
5,766,104 A * 6/1998 Albarelli, Jr. ..... 473/567
5,800,293 A 9/1998 MacKay, Jr.
5,820,438 A 10/1998 Horton, III
5,833,561 A 11/1998 Kennedy et al.
6,022,282 A 2/2000 Kennedy et al.
6,036,610 A 3/2000 Lewark
6,042,493 A 3/2000 Chauvin et al.
6,048,283 A * 4/2000 Albarelli, Jr. ..... 473/567

(Continued)

OTHER PUBLICATIONS

Brian Huang; Reebok Vector O Baseball Bat Excuse Me Sir, Is That a Hole in Your Bat?; http://gearpatrol.com/ blog/2009/04/21/reebok-vector-o-baseball-bat/; Apr. 21, 2009; pp. 1-6; Gear Patrol, United States.

(Continued)

*Primary Examiner*—Gene Kim
*Assistant Examiner*—M Chambers
(74) *Attorney, Agent, or Firm*—Matthew R. Schantz; Bingham McHale LLP

(57) ABSTRACT

A substantially hollow practice bat is disclosed, and is useable by baseball players and other athletes in training and/or rehabilitation sessions to develop stronger and more precise swinging habits. A user typically stands in a pool of water approximately chest-deep. He or she swings the device in an approximation of a proper swing for the sport. The device includes holes that tend to minimize turbulence that a standard bat would generate, yet provides both resistance and good haptic feedback to the user. These features develop or redevelop strength and consistency in the user's swing. Analogous training benefits are obtained for many activities, such as batting, golfing, and tennis.

6 Claims, 4 Drawing Sheets

U.S. PATENT DOCUMENTS 6,139,451 A 10/2000 Hillerich, III et al.
6,159,116 A 12/2000 Pitsenberger
6,325,727 B1 * 12/2001 Carr ..... 473/228
6,344,007 B1 2/2002 Feeney et al.
6,440,017 B1 8/2002 Anderson
6,461,260 B1 10/2002 Higginbotham
7,207,907 B2 * 4/2007 Guenther et al. ..... 473/566
7,214,152 B1 * 5/2007 Vacek et al. ..... 473/566
7,294,073 B1 11/2007 Vacek et al.

OTHER PUBLICATIONS

Reebok; Vector O Bat; http://www.reebok.com/US/#/product?modelld=RBK_ACC0007&arti...; pp. 1-2; Reebok, United States, Apr. 21, 2009.

* cited by examiner

WATER-BASED SPORT TRAINING

FIELD

The present invention relates to games using a tangible projectile. More specifically, the present invention relates to a device for developing consistent large motor movements, such as the swing of a bat in baseball or the swing of a racquet in tennis.

DESCRIPTION

Figure 1:
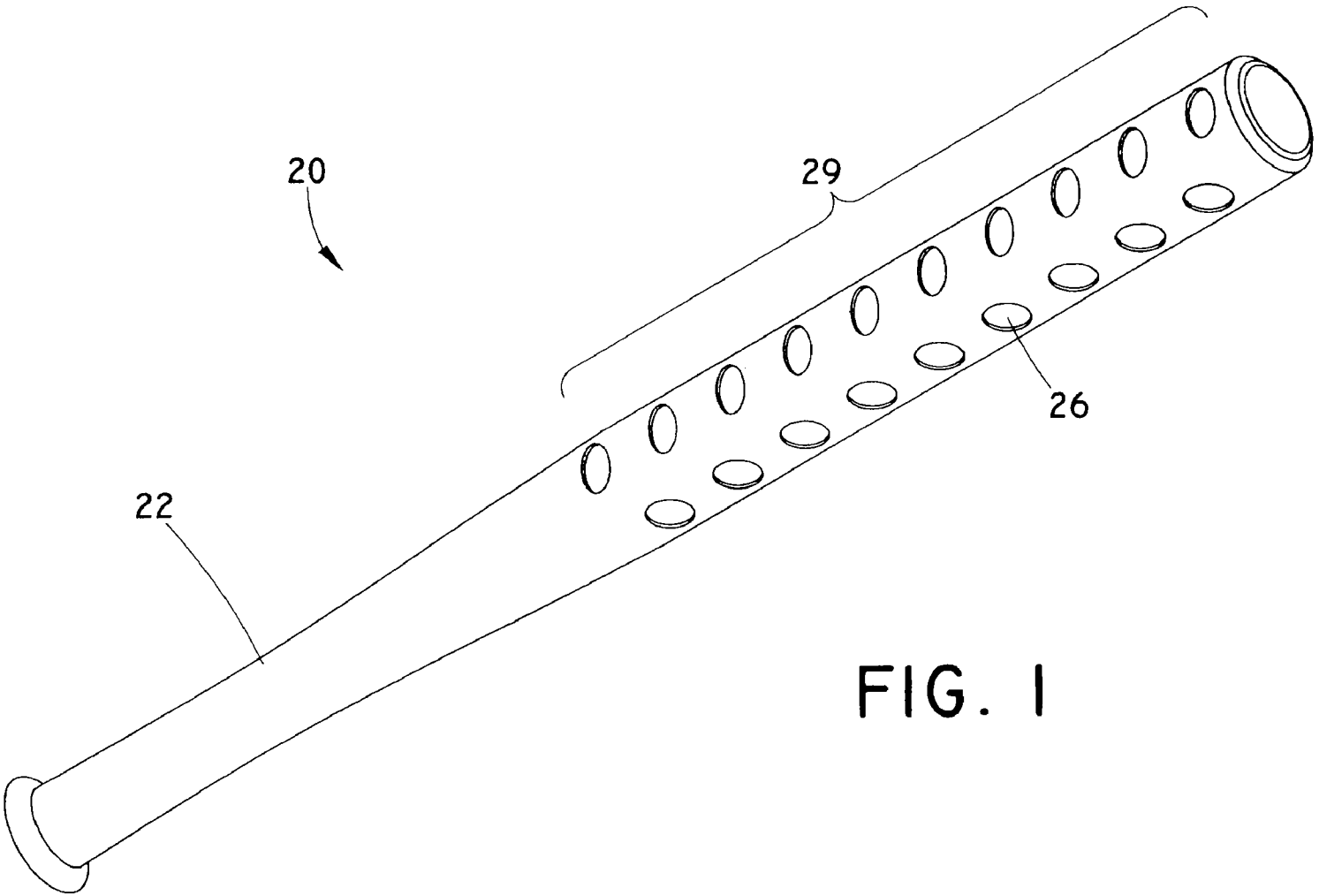
FIG. 1 is a perspective view of a practice bat in one embodiment.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Generally, one form of the present device is a substantially hollow practice bat useable by baseball players in training and rehabilitation sessions to develop or redevelop stronger and more precise upper body swinging habits. In this form, a user stands in a pool of water, approximately chest-deep. He or she holds the practice bat with both hands and swings it in a proper batting swing, so that (at least through the middle portion of the swing) it passes a few inches under the surface of the water in a level arc. As described in more detail herein, the practice bat includes structural features that tend to minimize turbulence that a standard bat would generate, yet provides both resistance and good haptic feedback to the user. These features develop (or, in some instances of rehabilitation, redevelop) strength and consistency in the user's swing. Analogous training and benefits are described for other activities, such as golf or tennis.

As illustrated in FIG. 1, bat 20 includes a handle portion 22 and a distal portion 24. Handle portion 22 in this embodiment is adapted to approximate the grip on a baseball bat, though in some embodiments, handle portion 22 is further adapted (for example, by wrapping a substantial portion of handle portion 22 with grip tape) to avoid slippage in the user's hands, particularly in wet environments. In this illustrated embodiment, practice bat 20 is constructed of polyvinyl chloride (PVC) pipe, though in other embodiments other materials such as graphite that are sufficiently resistant to shear forces are used, and in still other embodiments a combination or composite of materials is used.

Distal portion 24 of bat 20 is generally a hollow cylinder through which holes 26 are made around its circumference and along its length. In some embodiments, distal portion 24 has an outer diameter of approximately three inches, and holes 26 are each one-half inch in diameter, though in other embodiments the outer diameter and/or holes are larger or smaller. In this embodiment, holes 26 are drilled in a pattern by which two holes are placed on opposite sides of the bat, and the next two holes are placed somewhat further down the bat in an axial direction, and offset rotationally from the placement of the corresponding holes in the previous set. In some embodiments, holes 26 are all of the same size, while in others, the sizes vary in a repeating pattern, and in others the holes 26 are either monotonically increasing or monotonically decreasing in size along practice bat 20.

Figures 2, 3, 4:
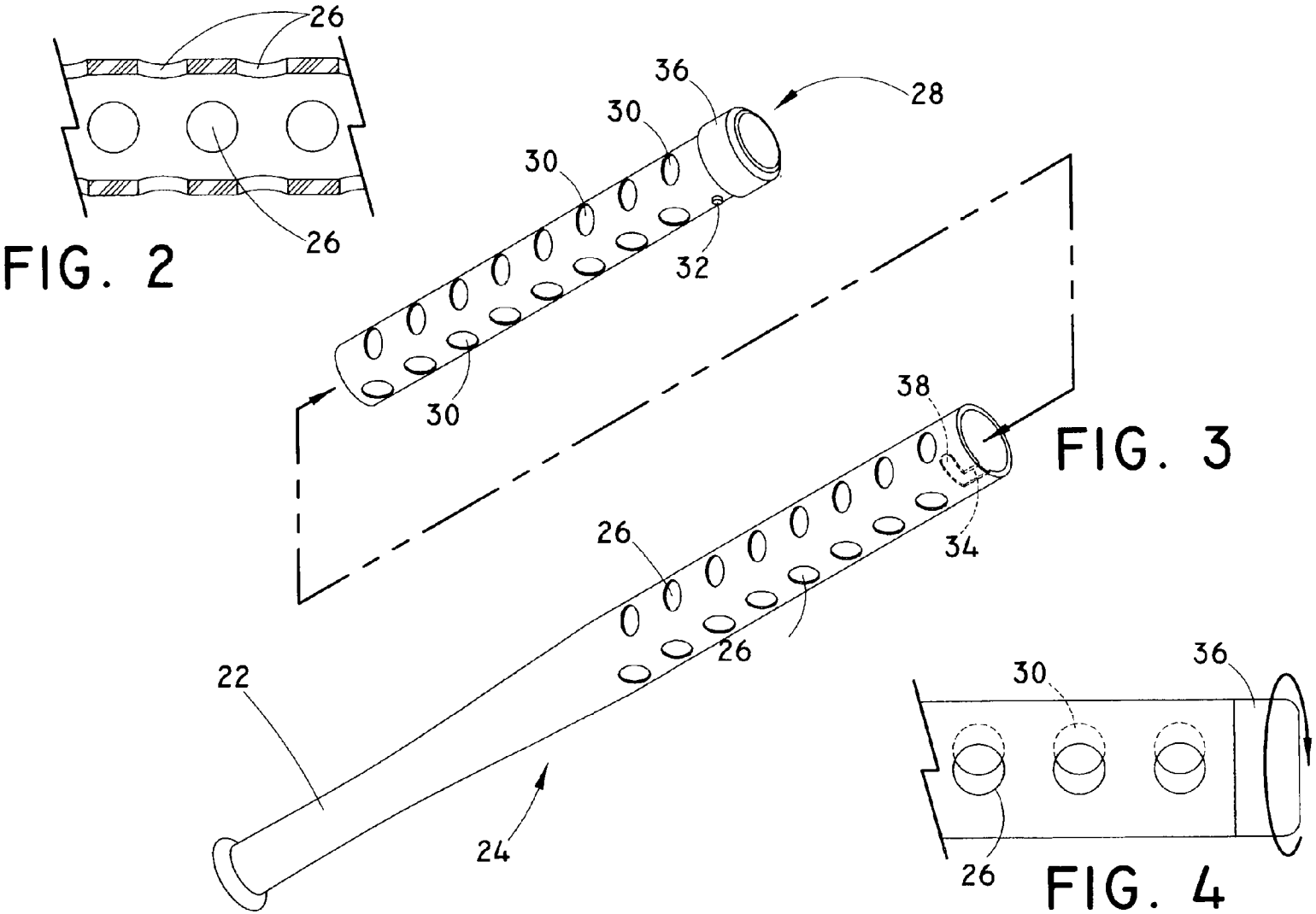
FIG. 2 is a cutaway view of the interior of the practice bat in FIG. 1.
FIG. 3 is an exploded view of an adjustable resistance practice bat, a variation of the embodiment in FIG. 1.
FIG. 4 is a side view of the adjustable-resistance practice bat of FIG. 3.

FIG. 2 illustrates a cutaway view of the inside of the distal portion 24 of bat 20. Holes 26 pass all of the way through the walls of distal portion 24 and are staggered in their positioning from one circumference to the next.

In a variation on the embodiment shown in FIG. 1, the size of openings 26 is variable, being adjustable by the user to accommodate a variety of levels of resistance and user skill. One such embodiment is shown in FIG. 3, where inner cylinder 28 defines holes 30, which are positioned in a pattern corresponding to holes 26 in distal portion 24 of practice bat 20. In this embodiment, post 32 extends radially from inner cylinder 28 so that, when inner cylinder 28 is fully inserted into outer cylinder 29, post 32 is received into locking slot 34. When inner cylinder 28 is fully inserted, post 32 extends to the bend in locking slot 34 and can be turned by the user (by grasping handle portion 22 and end cap 36, for example) to rotate them into place. When inner cylinder 28 has been rotated so that post 32 extends into leg portion 38 of locking slot 34, forces (such as centrifugal force during a swing) that would tend to push inner cylinder 28 out of outer cylinder 29 will be resisted sufficiently to prevent movement of inner cylinder 28 in that direction.

Rotational movement of inner cylinder 28 relative to outer cylinder 29 adjusts the alignment of inner holes 30 relative to outer holes 26 to increase or decrease the resistance provided to movement of practice bat 20 through water 52. This adjustment of end cap 36 and relative alignment of holes 26 and 30 are illustrated in FIG. 4.

Figure 7:
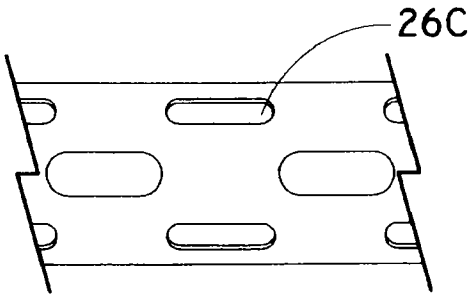
FIGS. 5-7 are cutaway side views of practice bats that are second, third, and fourth variations on the embodiment of FIG. 1.
Figure 6:
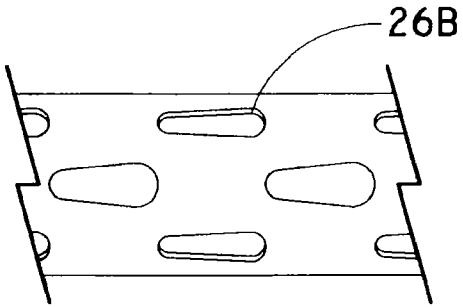
Figure 5:
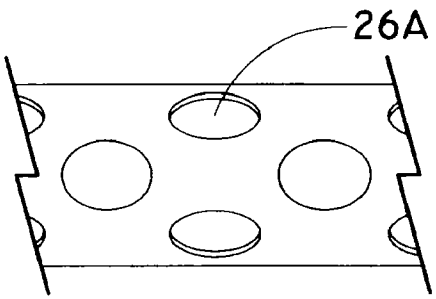

The embodiments illustrated in FIGS. 1-4 use round holes 26 and 30, but in other embodiments, the holes have different shapes. For example, FIG. 5 illustrates an embodiment wherein holes 26*a* have an elliptical shape, while in FIG. 6, holes 26*b* have a pear shape. In FIG. 7, holes 26*c* have the shape of a rectangle with rounded corners. Other shapes of holes will occur to those skilled in the art and will provide advantages such as adjustability, shear strength, or aesthetics.

Figure 8:
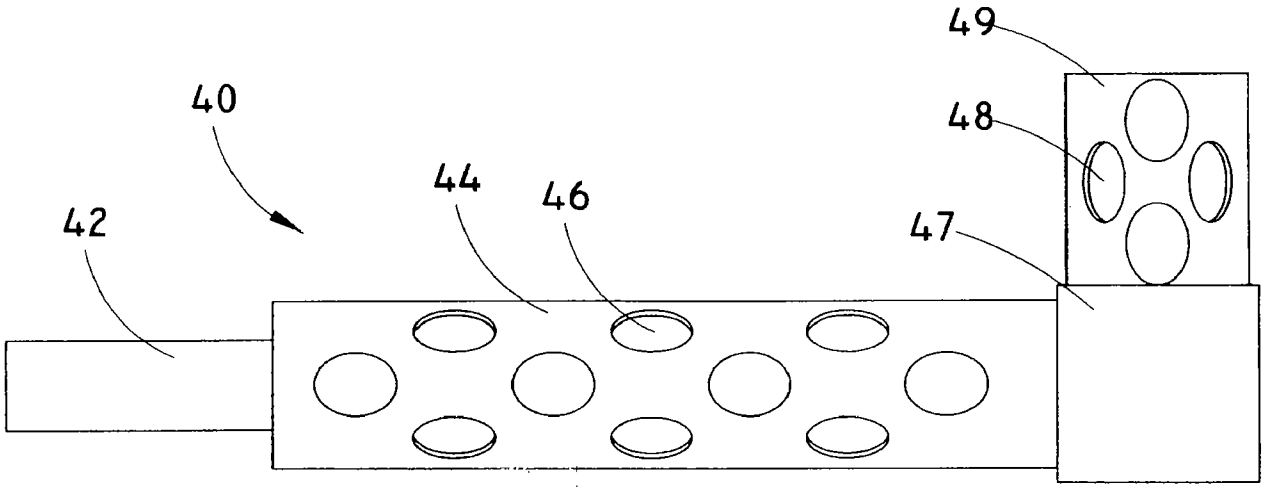
FIG. 8 is a side view of a practice golf club according to a further embodiment.
Figure 11:
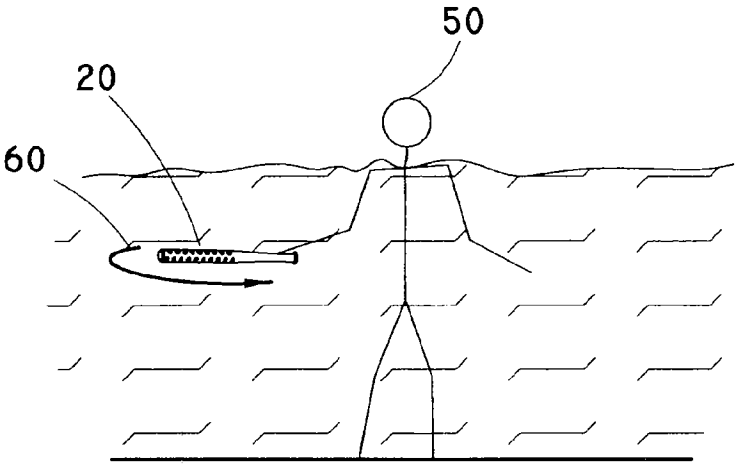
FIG. 9 and 11 are side views of a person using a practice bat according to FIG. 1.

FIG. 8 illustrates another embodiment of a practice device 40, wherein handle 42 resembles handle portion 22 of practice bat 20, and leg portion 44 resembles distal portion 24 of practice bat 20. Holes 46 pass through the exterior surface into a hollow interior of leg portion 44 and may have any of a variety of patterns. One difference in practice device 40 as compared to practice bat 20 is attachment of corner 47 and head piece 49, which is also drilled through with holes 48.

Operationally, practice club 40 passes through water much like practice bat 20, but with extra resistance to the motion due to head piece 49. This resistance results in torque about the axis of handle 42 and leg portion 44 resembles the torque about the shaft of a golf club during a swing. This torque helps train the user to compensate and maintain proper alignment of practice club 40 with the swing.

Figure 9:
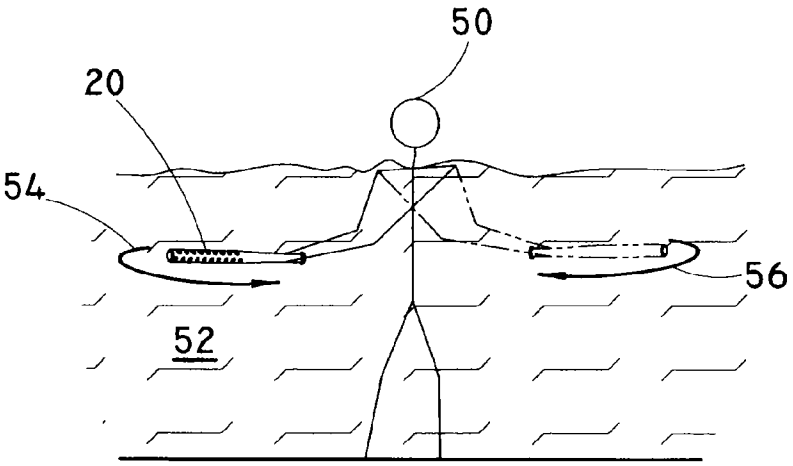
Figure 10:
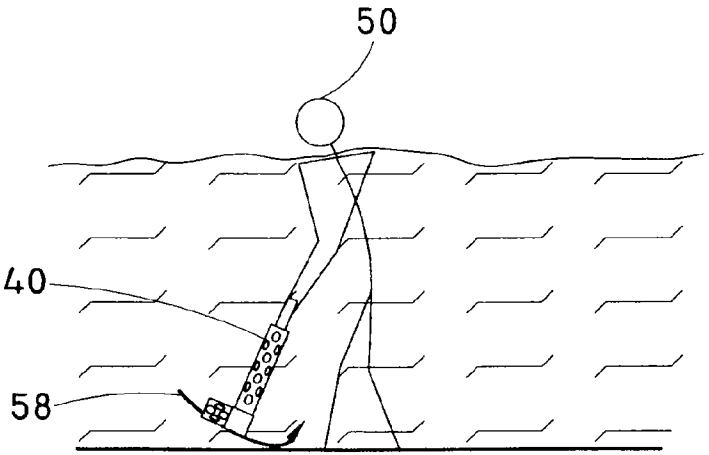
FIG. 10 is a side view of a person using a practice golf club according to FIG. 8.

In use, a user 50 stands in water 52 and simulates a batting swing with a motion illustrated by arrow 54, as shown in FIG. 9. The swinging motion is generally just under the surface of the water 52 when water 52 is at the appropriate height—about the level of the armpits of user 50. In some embodiments, return stroke 56 also maintains a depth just below the surface, both to strengthen muscles used in the stroke and to improve precision movement. Likewise, as shown in FIG. 10, user 50 moves practice club 40 through simulated swing 58 to analogous effect.

A wide variety of implementations will occur to those skilled in this area of technology. In one such example, the device is constructed with a roughly triangular cross-section instead of the round cross-section illustrated herein. In another, the cross-section is hexagonal, while in others the cross-sectional shape has a still different shape. In some embodiments, the device is (or is adapted to be) held in one hand, while in others it is (or is adapted to be) adapted to be held in two hands.

All publications, prior applications, and other documents cited herein are hereby incorporated by reference in their entirety as if each had been individually incorporated by reference and fully set forth. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A training and rehabilitation device, comprising:

a handle portion and a rigid, substantially cylindrical body portion having an outer surface that defines a plurality of holes and contains an open, inner cavity;

wherein the plurality of holes and inner cavity are connected and sufficiently large to reduce drag as the bat is moved through a fluid wherein said device, further comprising an inner cylinder within the outer surface, wherein: the inner cylinder rotates independently of the outer surface; and the inner cylinder has openings that allow fluid to pass between the plurality of holes and the inner cavity; wherein rotational movement of the inner cylinder relative to the outer surface changes the total surface area that is open between the outer surface and the inner cavity.

2. The device of claim 1, wherein the plurality of holes are spaced along the longitudinal dimension of the outer surface.

3. The device of claim 1, wherein the plurality of holes are spaced around the circumference of the outer surface.

4. A training and rehabilitation method, comprising swinging the device of claim 1 through water.

5. A method of training and rehabilitation utilizing the device of claim 1, comprising:

standing in water at least waist-deep;

holding a training member in both hands; and swinging the training member through the water;

wherein the training member comprises:

a handle portion and a rigid, substantially cylindrical body portion having an outer surface that defines a plurality of holes and contains an open, inner cavity; and wherein the plurality of holes and inner cavity are connected and sufficiently large to reduce drag as the training member is moved through the water.

6. The method of claim 5, wherein:

the training member further comprises an inner cylinder within the outer surface;

the inner cylinder rotates independently of the outer surface;

the inner cylinder has openings that allow fluid to pass between the plurality of holes and the inner cavity; and rotational movement of the inner cylinder changes relative alignment of the openings and the plurality of holes, thereby changing the total surface area that is open between the outer surface and the inner cavity.

* * * * *